United States Patent [19]

Trzeciak

[11] 4,170,441

[45] Oct. 9, 1979

[54] SPEED CHANGER FOR IN-HOLE MOTORS

[75] Inventor: Kurt H. Trzeciak, Fountain Valley, Calif.

[73] Assignee: Smith International, Inc., Newport Beach, Calif.

[21] Appl. No.: 844,375

[22] Filed: Oct. 21, 1977

[51] Int. Cl.[2] ..... F01C 1/10

[52] U.S. Cl. ..... 418/48; 74/804; 175/107

[58] Field of Search ..... 74/804, 805; 418/48; 175/106, 107

[56] References Cited

U.S. PATENT DOCUMENTS

| | | | |
|---|---|---|---|
| 3,291,230 | 12/1966 | Cullen et al. | 175/107 X |
| 4,080,115 | 3/1978 | Sims et al. | 418/48 |

*Primary Examiner*—Ronald C. Capossela

*Attorney, Agent, or Firm*—Subkow and Kriegel

[57] ABSTRACT

A helicoidal in-hole motor assembly has a speed change gear drive for converting the eccentric motion of the rotor to concentric rotation of the drive shaft at a different speed. The gear set is enclosed in a sealed housing containing gear lubricant. An eccentric yoke and bearing enable orbital motion of the drive gear.

24 Claims, 6 Drawing Figures

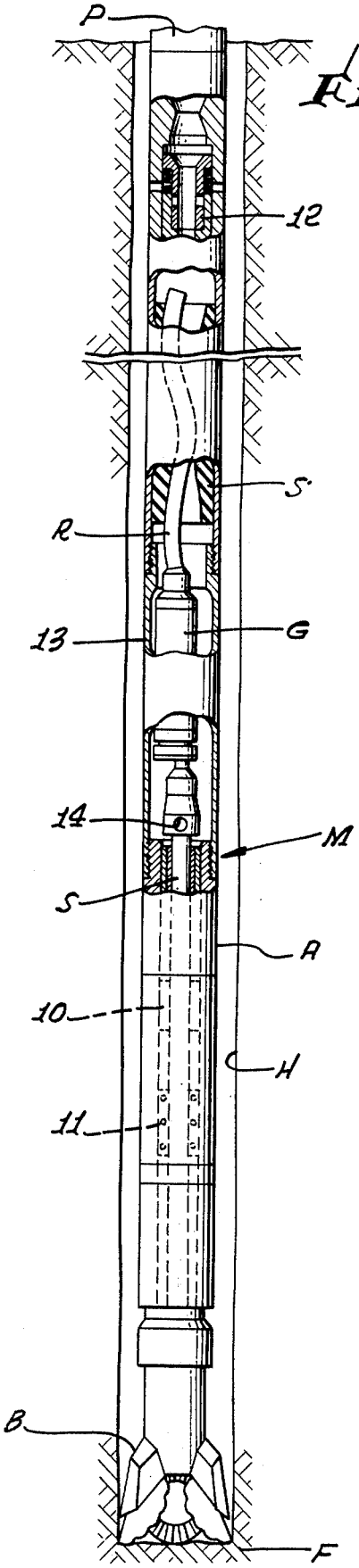
FIG. 1.
FIG. 3.
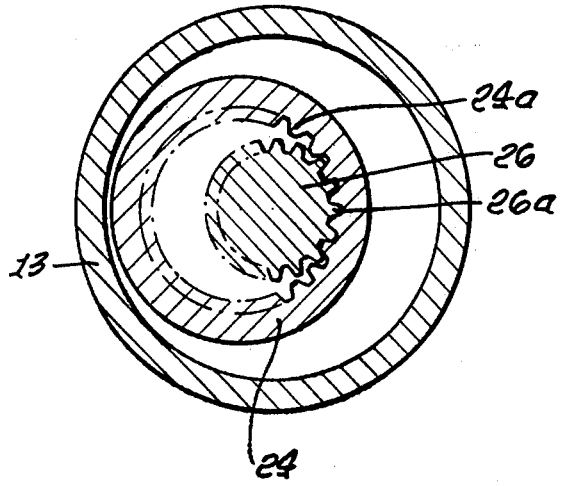

SPEED CHANGER FOR IN-HOLE MOTORS

BACKGROUND OF THE INVENTION

In the drilling of bore holes, such as well bores, mine bores or other bore holes into or through earth formation, utilizing a rotary bit, the drilling or penetration rate efficiency depends upon the weight or axial force applied by the drill bit and the speed of rotation. Various types of formations and types of bits as well as size or diameter of the bits require different weight or load on the bit and different speeds for maximum penetration rate.

Drilling of bore holes using drilling fluid, either mud or gas, also requires that the drilling fluid be circulated through the drill string and bore hole to flush cuttings and cool the bit.

When driving a rotary bit utilizing an in-hole motor, either of the positive displacement or the turbine type, which is driven by the drilling fluid, the motor speed is a function of the circulation rate and cannot always be varied to adjust the speed of rotation of the bit due to the requirements for adequate drilling fluid flow, and in the case of low-speed motors due to high friction if the circulation rate is increased to increase drill speed.

Heretofore, therefore, speed changers have been proposed for use in drilling with various in-hole motor drills. The proposal is relatively simple in the case of turbines, which operate, notoriously, at relatively high speed, as compared with in-hole motors of the positive displacement type, such as, for example, the helicoidal motors. The simplicity, in the case of turbine type motor drills to reduce or increase speed of the drill at any given motor speed is attributable to the axial alignment of the motor or turbine shaft and the drive shaft for the drill or bit. However, in the case of in-hole motors of the helicoidal type, the drive end of the helical rotor partakes of a compound motion, the center of the rotor rotating in one direction while orbiting in the opposite direction.

There is a need, however, in the use of in-hole motors of the helicoidal type, for enabling rotation of the drive shaft at a speed either greater or less than the speed of the rotor. Relatively small diameter drills are rotated at higher speeds than larger diameter drills to obtain optimism peripheral speed in a given formation.

SUMMARY OF THE INVENTION

The present invention provides a speed change drive or gear mechanism for driving the drive shaft of an in-hole motor at a different speed than the rotor of the motor.

More particularly, the gear drive is constructed, in one form, to increase the drive shaft speed, and, in another form, to decrease the drive shaft.

In each case, the gear which is the drive gear connected to the helicoidal motor rotor is allowed to partake of the reverse orbital motion inherent in such rotors, wherein as the rotor rotates in a given direction the center of the rotor also orbits in the opposite direction. In accordance with the present invention, such eccentric or orbital motion is permitted by connecting an internal pinion gear with an eccentric yoke or bearing unit, and in another eccentric bearing between an outer ring gear and the inner pinion in such a manner that the ring gear and pinion can partake of the eccentric or orbital motion while driving an output shaft concentrically journaled in the housing structure.

The speed changer device may also be used in combination with helicoidal fluid motors used for applications other than for drilling of bore holes in the earth, where varying the fluid flow may not be practical or desirable.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

BRIEF DESCRIPTION OF THE DRAWINGS

FIG. 1 is a view partly in elevation and partly in longitudinal section diagrammatically illustrating in-hole motor drill apparatus in accordance with the invention disposed in a bore hole;

FIG. 3 is a transverse section as taken on the line 3—3 of FIG. 2*a;*

DESCRIPTION OF THE PREFERRED EMBODIMENTS

Figure 2A:
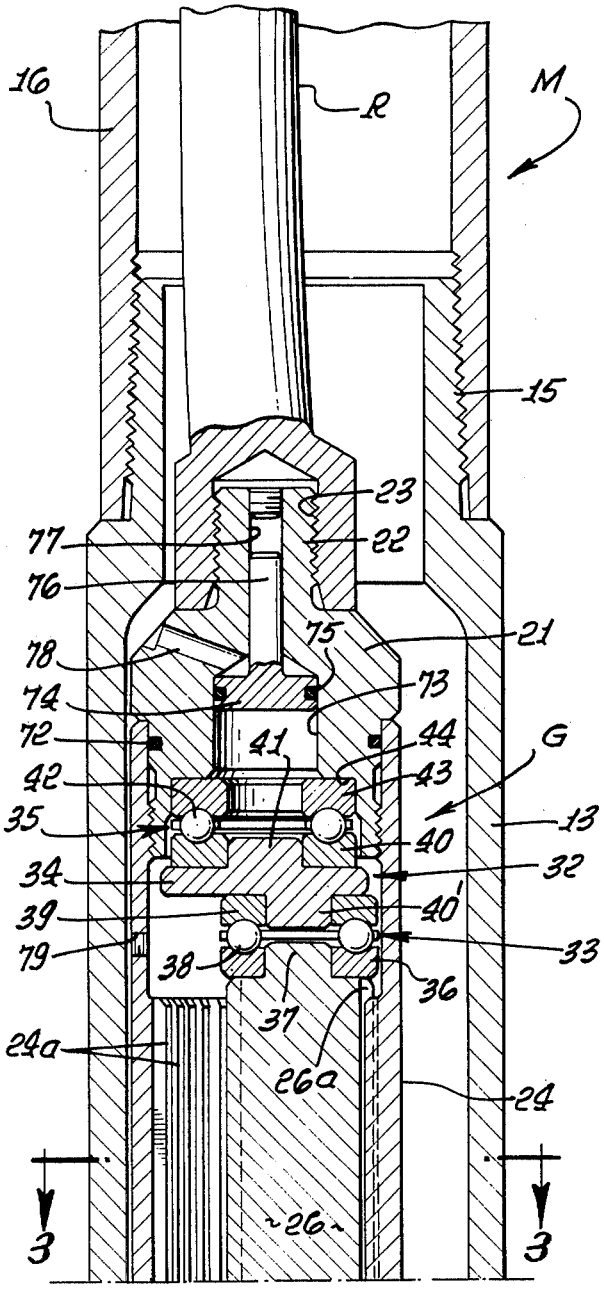
FIGS. 2*a* and 2*b*, together, constitute a longitudinal section through a speed increaser in accordance with the invention, FIG. 2*b* being a downward continuation of FIG. 2*a;*

Referring first to FIG. 1, a motor drill assembly M is shown disposed in a bore hole H which has been drilled by a bit B rotatable by the motor drill assembly in response to the circulation of drilling fluid downwardly through a length of drill pipe P, which extends to the top of the hole and is adapted to be held stationary in an appropriate manner. Drilling fluid circulates downwardly through the motor drill assembly M to cause rotation of a motor rotor R within the stator housing S. The motor illustrated is of the helicoidal positive displacement or progressive cavity type. Rotation is transmitted from the rotor R through a change speed gear assembly G to the drive shaft S of the motor drill assembly which is supported in a bearing assembly or housing A containing suitable radial bearings 10 and thrust bearings 11 which support the drive shaft S concentrically within the bearing housing and transmit weight or load from the pipe string P to the bit B to cause its penetration into the subsurface earth formation F, as the drilling progresses.

Drilling fluid is circulated downwardly through the drill pipe, and enters the motor housing through the usual upper valve 12, and passes downwardly through the stator S to drive the rotor at a speed determined by the rate of fluid flow, the fluid then passing downwardly through the tubular housing structure 13, entering through ports 14 at the upper end of the drive shaft S, and exiting through the bit B for return flow through the annular space between the tubular drill structure and the bore hole wall. While the speed of bit rotation is determined by the flow of drilling fluid through the motor, the effective penetration rate of the bit B is determined by the speed of rotation of the bit and the weight or axial loading force of the bit B against the base of the bore hole. This speed or weight, from time to time, must be varied in order to maintain maximum drilling penetration rate, depending upon the type of formation being drilled through and the type of bit being employed. Obviously the peripheral cutter speed of a relatively large bit is significantly higher than the peripheral cutter speed of a smaller bit, so that the same speed and weight conditions are not optimum for drilling through the same formation with different size bits. Neither is the same speed or weight optimum for drilling through different types of formation with the same size bit. However, the drilling of bore holes using in-hole motors of the helicoidal type herein illustrated involves converting the eccentric rotation of the rotor R into the concentric, stabilized rotation of the drive shaft S within the bearing assembly B, so that, typically, a connector rod has heretofore been employed between the motor rotor and the drive shaft, for example as described in the copending application, Ser. No. 838,649, filed Oct. 3, 1977.

In the present case, the gear drive or speed changing mechanism G is interposed between the motor rotor R and the drive shaft S in place of the usual connecting rod assembly, within the housing section 13.

Referring to FIGS. *2a* and *2b*, the gear drive mechanism G is shown in greater detail. The housing section 13 provides a tubular body structure having an upper threaded end 15 connected to the lower end of the motor housing 16, and a lower internally threaded end 17 connected to the upper threaded end 18 of the bearing housing 19. The drilling fluid flowing downwardly through the housing section 13 about the exterior of the gear mechanism G enters the drive shaft S through the ports 14 which communicate with a longitudinally extended passage 20 in the tubular drive shaft, which extends downwardly through the bearing housing 19 through the radial and thrust bearings 10 and 11, previously referred to.

The gear mechanism G includes an upper connector head 21 having a threaded neck 22 engaged within the threaded bore 23 at the lower end of the helicoidal motor rotor R. An elongated planetary gear housing 24 extends downwardly from the connector head 21 to a seal assembly generally denoted at 25, and an internal pinion or satellite gear 26 is disposed within the planetary housing and is connected at its lower end 27 in the threaded socket 28 of a connector 29 having a threaded neck 30 engaged within the threaded bore 31 at the upper end of the tubular drive shaft.

The motion of the rotor R imparted to the upper head or connector 21, due to the helicoidal shape of the rotor, results in an orbital revolution of the head 21 and consequently the housing 24 in a direction opposite the direction of rotation of the rotor R. In other words, each revolution of the rotor R in one direction results in an orbital revolution of the lower end of the rotor about its own axis in the opposite direction. Such motion is according to the present invention, converted to pure rotary motion of the drive shaft S through the intermediary of the planetary gear housing 24 and the internal satellite gear 26. Thus, at the upper end of the gear 26, between it and the connector head 21 is an eccentric bearing assembly 32, including first bearing means 33 connected between the shaft 26 and a crank or eccentric connector yoke 34 and a second bearing means 35, which is interposed between the crank or eccentric connector 34 and the connector head 21. The lower or first bearing means 33 includes a lower race 36 disposed upon an upper projection 37 on the shaft 26 and engaged by a plurality of bearing balls 38 which are also engaged by the upper race 39 carried on a downward projection 40' of the crank or eccentric connector member 34. The upper bearing means 35 includes a lower race 40 carried on an upward projection 41 of the eccentric connector or crank 34 and engaged by a plurality of bearing balls 42, which also engage an upper race 43 disposed within a seat 44 in the connector head 21. The bearing means 33 and 35, together with the eccentric or crank member 34, thus enable the connector head 21 to partake of the eccentric or orbital motion imparted thereto from the rotor R, while the output gear 26 revolves on a fixed axis.

Adjacent the lower end of the planetary gear housing 24, between it and the lower end of the gear 26 is a lower bearing means 45 rotatably interconnecting the housing and the internal gear for rotation of the shaft upon the fixed axis while the planetary gear housing 24 revolves or orbits. This bearing means 45 includes an upper bearing race member 46 carried by the lower reduced section 47 of the gear 26, engaging a plurality of bearing balls 48 which ride in a raceway 49 provided on an eccentric bearing race member 50. This member 50 is eccentrically mounted upon the lower end 47 of the gear 26 but is concentric within the planetary gear housing 24 and engages a series of bearing balls 51 beneath the eccentric bearing plate 50 and a lower race member 52 disposed within the gear housing and abutting against a threadedly adjustable seal supporting sleeve 53 threaded at 54 into the lower end of the gear housing, and having a suitable side ring seal 55 sealingly engaged within the housing.

The structure as thus far described is adapted to impart to the output gear 26 rotation at a speed in excess of the speed of revolution of the planetary gear housing 24, and in the same sense, depending upon the desired ratio of input to output speed. The number of internal teeth 24a within the planetary gear housing 24 and 26a on the pinion or satellite gear 26, of course, will determine the speed ratio.

Since the speed increaser, now being described, is operating in a hostile environment, namely, the environment of the very erosive drilling fluid which is circulated downwardly through the motor, through the intermediate housing section 13, and into the tubular drive shaft S to drive the drill, means are accordingly provided to contain within the gear drive a quantity of gear oil or lubricant which is isolated from the hostile drilling fluid and which is internally pressurized to assist in preventing the intrusion of the drilling fluid into the planetary gear housing.

As seen in FIG. *2b*, mechanical sealing means 25, as previously referred to, are adapted to seal the lower end of the planetary gear housing 24 between it and the connector 29, while allowing the drive shaft S to revolve about its fixed axis and allowing the orbital motion of the planetary gear housing gear 24, the axis of rotation of which gyrates about the fixed axis of rotation of the gear 26 and the drive shaft. Accordingly, carried by the sealing sleeve 53, at the lower end of the planetary gear housing 24 is a mechanical seal ring 56, of suitable wear resistant material, which is disposed within a lower bore 57 in the sealing sleeve and held against rotation in the bore by suitable pin or key members 58 engaging in companion ways or slot in the seal ring 56. A side ring seal 59 is disposed between the mechanical seal ring 56 and the support sleeve 53, and the support 53 is locked with respect to the gear housing 24 by suitable set screws 60 carried by the sleeve 53 and engaged with the housing. Cooperative with the mechanical seal ring 56 is another mechanical sealing disc or ring 61 having a broad radial upper face 62 in slidable and sealing relation to the mechanical seal ring 56. The sealing plate or ring 61 is fixed within a seat 63 of a support sleeve 64 which is reciprocably disposed within an outer supporting sleeve 65, which, in turn, is keyed or otherwise fixed to the connector 29 as by means of pins 66, whereby the lower support sleeve 65 rotates with the connector 29. A suitable internal side ring seal 67 is provided between the central cylindrical body section 68 of the connector 29 and the internal cylindrical wall of the connector member 65. The seal ring or plate support 64 is longitudinally slotted at 69 and receives drive pins or keys 70 carried by the lower support sleeve 65, whereby the seal support sleeve 64 is caused to rotate with the lower support 65 and with the connector 29, while being capable of longitudinal movement, under the influence of an internal coiled spring 71, which seats at its lower end on an upwardly facing shoulder provided by the lower connector 65 and a downwardly facing shoulder provided by the upper connector sleeve 64, whereby the companion or opposed radial faces of the mechanical seal ring 56 and the sealing ring or plate 61 are normally maintained in sliding and sealing contact.

At its upper end, the planetary gear housing 24 is, as previously indicated, threadedly connected to the connector head 21 and a suitable side ring seal 72 is provided between the head and the housing to prevent the transfer of drilling fluid from the exterior of the gear assembly to the interior thereof. Within the connector head 21 is a piston chamber 73 which opens downwardly into the gear housing 24 and receives a separator piston 74 having a suitable side or piston ring seal 75 slidably and sealingly engaging within the piston chamber 73. Projecting upwardly from the piston 74 is a pilot guide stem 76 which extends into an elongated bore 77 in the neck of the connector 21, to guide the piston 74. A suitable passageway or port 78 leads from the exterior of the connector 21 to the piston chamber 73 above the piston 74, so that the piston is exposed to the pressure of drilling fluid externally of the gear housing 24. Thus, the gear lube or oil within the gear assembly can be pressurized to the pressure of drilling fluid, and is contained within the gear housing by the mechanical sealing means 25, while the gear housing and internal gear are enabled to relatively revolve and to partake of the relative orbital or gyratory motion.

Filling of the speed changer with lubricant is enabled by the provision in the housing 24 and the head 29 of suitable fill and bleed openings 79 and 80.

Figure 2B:
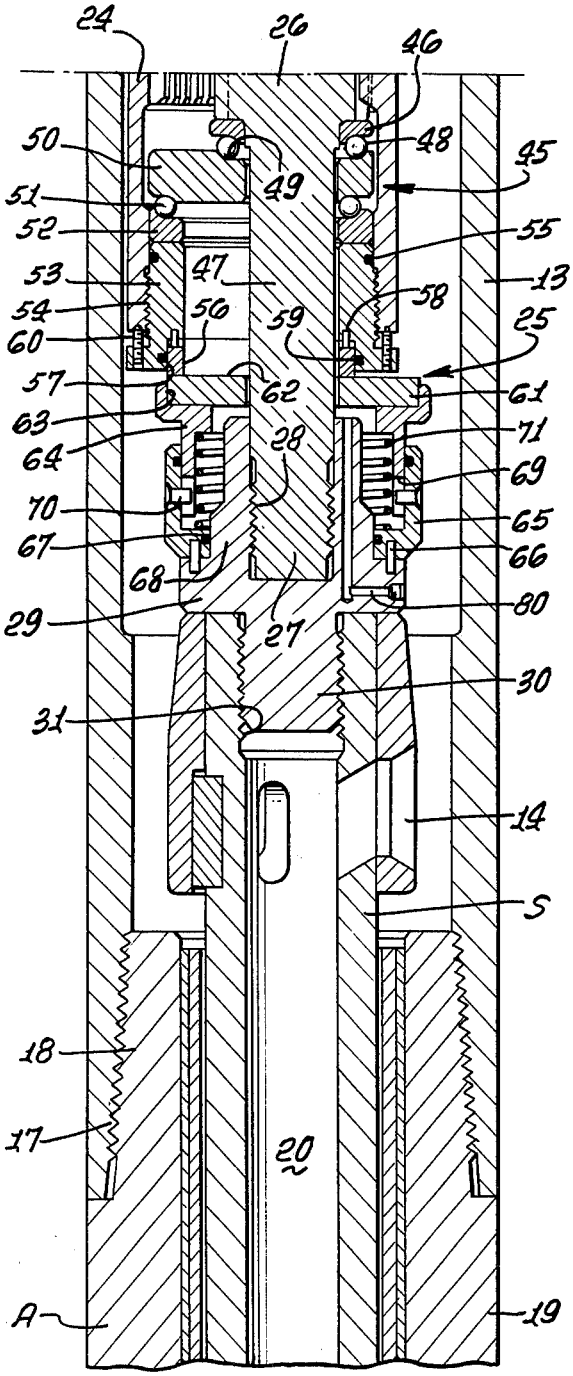
Figure 4A:
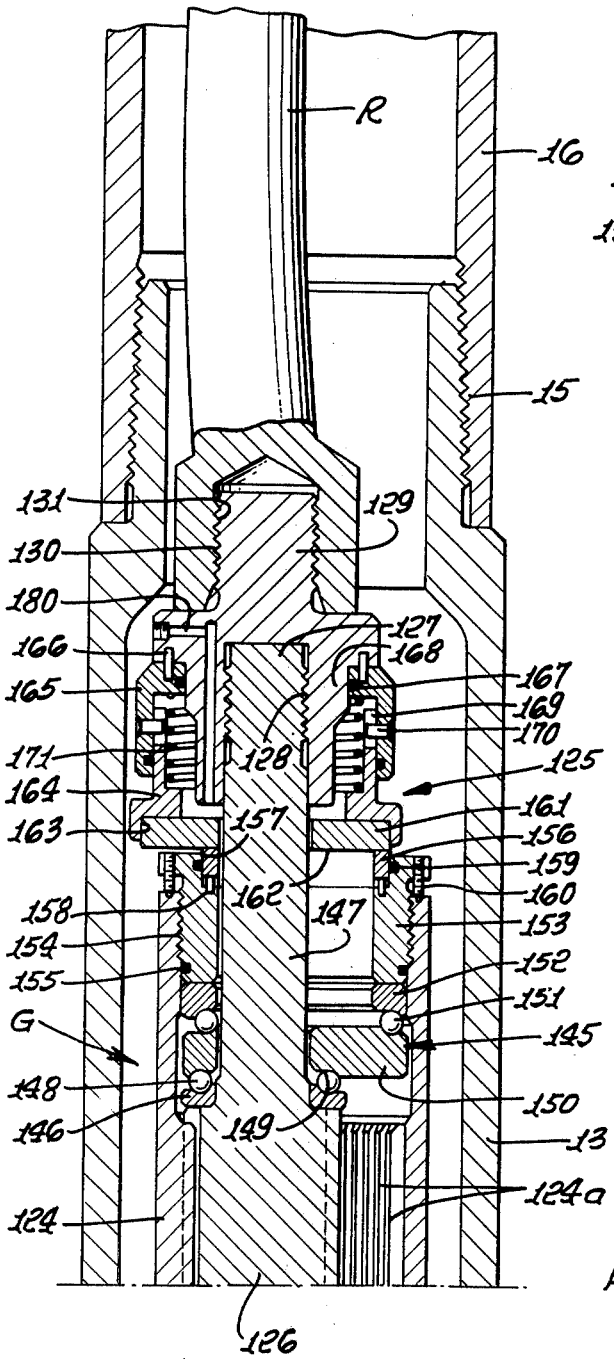
FIGS. 4*a* and 4*b*, together, constitute a longitudinal section through a speed decreaser made in accordance with the invention.
Figure 4B:
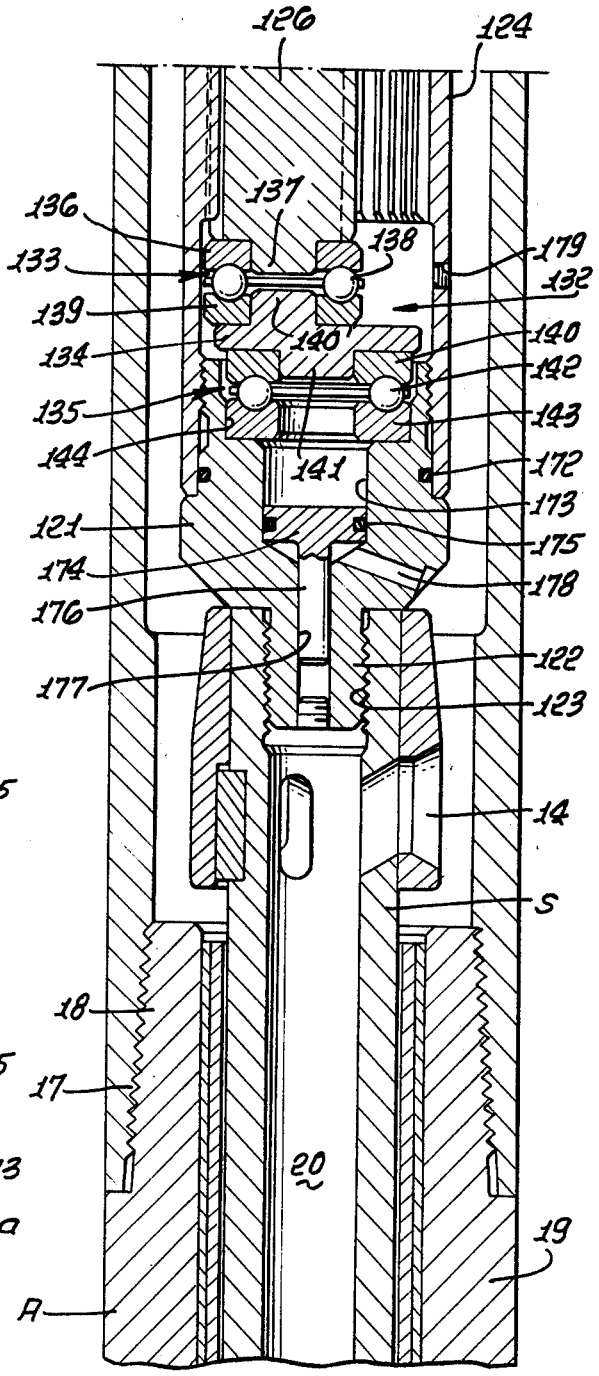

Referring to FIGS. 4*a* and 4*b*, another embodiment of the gear drive mechanism G is shown in greater detail. The housing section 13, as in the form of FIGS. 2*a* and 2*b*, provides a tubular body structure having the upper threaded end 15 connected to the lower end of the motor housing 16, and a lower internally threaded end 17 connected to the upper threaded end 18 of the bearing housing 19. The drilling fluid flowing downwardly through the housing section 13 about the exterior of the gear mechanism G enters the drive shaft S through the ports 14 which communicate with a longitudinally extended passage 20 in the tubular drive shaft, which extends downwardly through the bearing housing 19 through the radial and thrust bearings 10 and 11, previously referred to.

The gear mechanism G in this form includes a lower connector head 121 having a threaded neck 122 engaged within the threaded bore 123 at the upper end of the drive shaft. An elongated planetary gear housing 124 extends upwardly from the connector head 121 to a seal assembly generally denoted at 125, and an internal pinion or satellite gear 126 is disposed within the planetary housing and is connected at its upper end 127 in the threaded socket 128 of a connector 129 having a threaded neck 130 engaged within the threaded bore 131 at the lower end of the helicoidal rotor R.

The motion of the rotor R imparted to the lower head connector 129, due to the helicoidal shape of the rotor, results in an orbital revolution of the head 129 and consequently the pinion 126 in a direction opposite the direction of rotation of the rotor R. In other words, each revolution of the rotor R in one direction results in an orbital revolution of the lower end of the rotor about its own axis in the opposite direction. Such motion is according to the present invention, converted to pure rotary motion of the drive shaft S through the intermediary of the planetary gear housing 124 and the internal satellite or pinion gear 126. Thus, at the lower end of the gear 126, between it and the connector head 121 is an eccentric bearing assembly 132, including first bearing means 133 connected between the shaft 126 and a crank or eccentric connector member or yoke 134 and a second bearing means 135, which is interposed between the crank or eccentric connector 134 and the connector head 121. The upper or first bearing means 133 includes an upper race 136 disposed upon a lower projection 137 on the shaft 126 and engaged by a plurality of bearing balls 138 which are also engaged by the lower race 139 carried on an upward projection 140' of the crank or eccentric connector member 134. The lower bearing means 135 includes an upper race 140 carried on a downward projection 141 of the eccentric connector or crank 134 and engaged by a plurality of bearing balls 142, which also engage a lower race 143 disposed within a seat 144 in the connector head 121. The bearing means 133 and 135, together with the eccentric or crank member 134, thus enable the connector head 121 to partake of the eccentric or orbital motion imparted thereto from the rotor R and the input or drive gear 126, while the output gear or housing 124 revolves on a fixed axis.

Adjacent the upper end of the planetary gear housing 124, between it and the upper end of the gear 126 is an upper bearing means 145 rotatably interconnecting the housing and the internal gear for rotation of the shaft upon the fixed axis while the drive gear housing 126 revolves or orbits as it rotates. This bearing means 145 includes a lower bearing race member 146 carried by the upper reduced section 147 of the gear 126, engaging a plurality of bearing balls 148 which ride in a raceway 149 provided on an eccentric bearing race member 150. This member 150 is eccentrically mounted upon the upper end 147 of the gear 126 but is concentric within the planetary gear housing 124 and engages a series of bearing balls 151 above the eccentric bearing plate 150 and an upper race member 152 disposed within the gear housing and abutting against a threadedly adjustable seal supporting sleeve 153 threaded at 154 into the upper end of the gear housing, and having a suitable side ring seal 155 sealingly engaged within the housing.

The structure as thus far described is adapted to impart to the output gear 124 rotation at a speed less than the speed of revolution of the pinion or input gear 126, and in the same sense, depending upon the desired ratio of input to output speed. The number of internal teeth 124a within the planetary gear housing 124 and 126a on the pinion or satellite gear 26, of course, will determine the speed ratio.

Since the speed decreaser, now being described, is operating in a hostile environment, namely, the environment of the very erosive drilling fluid which is circulated downwardly through the motor, through the intermediate housing section 13, and into the tubular drive shaft S to drive the drill, means are accordingly provided to contain within the gear drive a quantity of gear oil or lubricant which is isolated from the hostile drilling fluid and which is internally pressurized to assist in preventing the intrusion of the drilling fluid into the planetary gear housing.

As seen in FIG. 4a, mechanical sealing means 125, as previously referred to, are adapted to seal the upper end of the planetary gear housing 124 between it and the connector 129, while allowing the rotor R to revolve about its fixed axis and allowing the orbital motion of the pinion gear 126, the axis of rotation of which gyrates about the fixed axis of rotation of the gear housing 124 and the drive shaft. Accordingly, carried by the sealing sleeve 153, at the upper end of the planetary gear housing 124 is a mechanical seal ring 156, of suitable wear resistant material, which is disposed within a bore 157 in the sealing sleeve and held against rotation in the bore by suitable pin or key members 158 engaging in companion ways or slot in the seal ring 156. A side ring seal 159 is disposed between the mechanical seal ring 156 and the support sleeve 153, and the support 153 is locked with respect to the gear housing 124 by suitable set screws 160 carried by the sleeve 153 and engaged with the housing. Cooperative with the mechanical seal ring 156 is another mechanical sealing disc or ring 161 having a broad radial lower face 162 in slidable and sealing relation to the mechanical seal ring 156. The sealing plate or ring 161 is fixed within a seat 163 of a support sleeve 164 which is reciprocably disposed within an outer supporting sleeve 165, which, in turn, is keyed or otherwise fixed to the connector 129 as by means of pins 166, whereby the upper support sleeve 165 rotates with the connector 129. A suitable internal side ring seal 167 is provided between the central cylindrical body section 168 of the connector 129 and the internal cylindrical wall of the connector member 165. The seal ring or plate support 164 is longitudinally slotted at 169 and receives drive pins or keys 170 carried by the upper support sleeve 165, whereby the seal support sleeve 164 is caused to rotate with the upper support 165 and with the connector 129, while being capable of longitudinal movement, under the influence of an internal coiled spring 171, which seats at its upper end on a downwardly facing shoulder provided by the upper connector 165 and an upwardly facing shoulder provided by the lower connector sleeve 164, whereby the companion or opposed radial faces of the mechanical seal ring 156 and the sealing ring or plate 161 are normally maintained in sliding and sealing contact.

At its lower end, the planetary gear housing 124 is, as previously indicated, threadedly connected to the connector head 121 and a suitable side ring seal 172 is provided between the head and the housing to prevent the transfer of drilling fluid from the exterior of the gear assembly to the interior thereof. Within the connector head 121 is a piston chamber 173 which opens upwardly into the gear housing 124 and receives a separator piston 174 having a suitable side or piston ring seal 175 slidably and sealingly engaging within the piston chamber 173. Projecting downwardly from the piston 174 is a pilot guide stem 176 which extends into an elongated bore 177 in the neck of the connector 121, to guide the piston 174. A suitable passageway or port 178 leads from the exterior of the connector 121 to the piston chamber 173 below the piston 174, so that the piston is exposed to the pressure of drilling fluid externally of the gear housing 124. Thus, the gear lube or oil within the gear assembly can be pressurized to the pressure of drilling fluid, and is contained within the gear housing by the machanical sealing means 125, while the gear housing and internal gear are enabled to relatively revolve and to partake of the relative orbital or gyratory motion.

Filling of the speed changer with lubricant is enabled by the provision in the housing 124 and the head 129 of suitable fill and bleed openings 179 and 180.

From the foregoing it will now be apparent that the invention provides novel change speed means which centers the eccentric revolution of the helicoidal drive rotor with respect to the fixed axis of rotation of the drive shaft, and enables the shaft speed to be increased or decreased, as may be desired, by substituting units G having different ratios of input to output speed. Such changes can enable the maintenance of near optimum speed of bits of different sizes in earth formations of different types to maintain a more effective penetration rate, without altering the rate of fluid circulation.

I claim:

1. In-hole fluid motor apparatus comprising: a fluid motor having a stator and a fluid driven helicoidal rotor having a drive end which rotates in one direction and orbits about its center in the opposite direction; change speed means including a drive member connected with said rotor and a driven member; a drive shaft connected with said driven member, means concentrically mounting said drive shaft with respect to said stator; and means enabling orbital motion of said drive member with respect to said driven member, one of said drive member or said driven member comprising a housing; and including means sealing said housing to contain a lubricant for said members while allowing said orbital motion.

2. In-hole fluid motor apparatus as defined in claim 1; said drive member being a ring gear in said housing, said driven member being a pinion in mesh with said ring gear internally of the latter.

3. In-hole fluid motor apparatus as defined in claim 1; said drive member being a pinion gear, said driven member being a ring gear in said housing in mesh with said pinion and extending about the latter.

4. In-hole fluid motor apparatus as defined in claim 1; one of said drive member and said driven member being a pinion gear, the other of said drive member and said driven member being a ring gear in said housing in mesh with said pinion gear, said means enabling orbital motion of said drive member including bearing means and a yoke centering the orbital motion of said drive member with respect to said driven member and drive shaft.

5. In-hole fluid motor apparatus as defined in claim 1; one of said drive member and said driven member being a pinion gear, the other of said drive member and said driven member being a ring gear in said housing in mesh with said pinion gear, said means enabling orbital motion of said drive member including bearing means and a yoke centering the orbital motion of said drive member with respect to said driven member and drive shaft, and eccentric bearing means between said drive member and said driven member.

6. In-hole fluid motor apparatus as defined in claim 1; said drive member being a ring gear in said housing, said driven member being a pinion in mesh with said ring gear internally of the latter, said means enabling orbital motion including eccentric bearing means centering the orbital motion of said ring gear with respect to said pinion and drive shaft.

7. In-hole fluid motor apparatus as defined in claim 1; said drive member being a ring gear in said housing, said driven member being a pinion in mesh with said ring gear internally of the latter, said means enabling orbital motion including eccentric bearing means centering the orbital motion of said ring gear with respect to said pinion and drive shaft, and eccentric bearing means between said housing and said pinion.

8. In-hole fluid motor apparatus as defined in claim 1; said drive member being a pinion, said driven member being a ring gear in said housing in mesh with said pinion internally of the ring gear, said means enabling orbital motion including eccentric bearing means centering the orbital motion of said pinion with respect to said housing and said drive shaft.

9. In-hole fluid motor apparatus as defined in claim 1; said drive member being a pinion, said driven member being a ring gear in said housing in mesh with said pinion internally of the ring gear, said means enabling orbital motion including eccentric bearing means centering the orbital motion of said pinion with respect to said housing and said drive shaft, and eccentric bearing means between said housing and said pinion.

10. In-hole fluid motor apparatus as defined in claim 1; including means in pressure transfer relation between the interior of said housing and fluid exterior of said housing.

11. In-hole fluid motor apparatus comprising: a fluid motor having a stator and a fluid driven helicoidal rotor having a drive end which rotates in one direction and orbits about its center in the opposite direction; change speed means including a drive member connected with said rotor and a driven member; a drive shaft connected with said driven member, means concentrically mounting said drive shaft with respect to said stator; and means enabling orbital motion of said drive member with respect to said driven member; said change speed means including sealed housing structure for containing a quantity of lubricant and means in pressure transfer relation between the interior of said housing structure and fluid exterior of said housing structure, said sealed housing structure including mechanical seal means having opposing seal faces slidably engaged to enable said orbital motion.

12. In-hole fluid motor apparatus comprising: a fluid motor having a stator and a fluid driven helicoidal rotor having a drive end which rotates in one direction and orbits about its center in the opposite direction; change speed means including a drive member connected with said rotor and a driven member; a drive shaft connected with said driven member, means concentrically mounting said drive shaft with respect to said stator; and means enabling orbital motion of said drive member with respect to said driven member; one of said drive member and said driven member being an elongated housing having a ring gear therein, the other member being a pinion in mesh with said ring gear, means for sealing said housing about said pinion including a mechanical seal structure having a pair of seal rings with radial opposed faces, one of said rings being rotatable and orbitally movable with said drive member with respect to the other of said rings and said driven member.

13. In-hole motor apparatus as defined in claim 12; including pressure transfer means for pressurizing a lubricant in said housing responsive to the pressure of fluid externally of said housing.

14. A speed changer for use between rotary devices having shafts, one of which rotates on a fixed axis and the other of which rotates in one direction on a center which gyrates in the opposite direction, said speed changer comprising; a drive member having means connectable to one shaft; a driven member having means connectable to the other shaft; means on said members for rotating said driven member at a speed different than said drive member; and means enabling orbital movement of one of said members in a direction opposite to the direction of rotation of said drive member and rotation of said driven member by said drive member; one of said drive member and said driven member being a pinion gear, the other of said drive member and said driven member being a ring gear in mesh with said pinion gear, said means enabling orbital movement of one of said members including bearing means and a yoke centering the orbital motion of said one of said members with respect to the other of said members, and eccentric bearing means between said drive member and said driven member.

15. A speed changer for use between rotary devices having shafts, one of which rotates on a fixed axis and the other of which rotates in one direction on a center which gyrates in the opposite direction, said speed changer comprising: a drive member having means connectable to one shaft; a driven member having means connectable to the other shaft; means on said members for rotating said driven member at a speed different than said drive member; and means enabling orbital movement of one of said members in a direction opposite to the direction of rotation of said drive member and rotation of said driven member by said drive member, one of said members including sealed housing structure for containing a quantity of lubricant and means in pressure transfer relation between the interior of said housing structure and fluid exterior of said housing structure.

16. A speed changer for use between rotary devices having shafts, one of which rotates on a fixed axis and the other of which rotates in one direction on a center which gyrates in the opposite direction, said speed changer comprising: a drive member having means connectable to one shaft; a driven member having means connectable to the other shaft; means on said members for rotating said driven member at a speed different than said drive member; and means enabling orbital movement of one of said members in a direction opposite to the direction of rotation of said drive member and rotation of said driven member by said drive member; one of said drive member and said driven member being an elongated housing having a ring gear therein, the other member being a pinion in mesh with said ring gear, means for sealing said housing about said pinion including a mechanical seal structure having a pair of seal rings with radial opposed faces, one of said rings being rotatable and orbitally movable with said drive member with respect to the other of said rings and said driven member.

17. A speed changer as defined in claim 16, including pressure transfer means for pressurizing a lubricant in said housing responsive to the pressure of fluid externally of said housing.

18. A speed changer for use between rotary devices having shafts, one of which rotates on a fixed axis and the other of which rotates in one direction on a center which gyrates in the opposite direction, said speed changer comprising: a drive member having means connectable to one shaft; a driven member having means connectable to the other shaft; means on said members for rotating said driven member at a speed different than said drive member; and means enabling orbital movement of one of said members in a direction opposite to the direction of rotation of said drive member and rotation of said driven member by said drive member; said drive member comprising an elongated housing having a ring gear therein, said means connectable to one shaft being mounted to said housing and having a central bearing; said driven member being a pinion gear in mesh with said ring gear, eccentric bearing means mounting said pinion gear at one end in said housing for relative orbital motion of said housing; bearing means at the other end of said pinion; and an eccentric yoke engaged between the last-mentioned bearing means and said contral bearing.

19. A speed changer for use between rotary devices having shafts, one of which rotates on a fixed axis and the other of which rotates in one direction on a center which gyrates in the opposite direction, said speed changer comprising: a drive member having means connectable to one shaft; a driven member having means connectable to the other shaft; means on said members for rotating said driven member at a speed different than said drive member; and means enabling orbital movement of one of said members in a direction opposite to the direction of rotation of said drive member and rotation of said driven member by said drive member; said drive member being a pinion gear, said driven member being a housing having a ring gear therein in mesh with said pinion gear, said means connectable to one shaft being mounted to said housing and having a central bearing, eccentric bearing means mounting said pinion gear at one end in said housing for relative orbital motion of said housing; bearing means at the other end of said pinion; and an eccentric yoke engaged between the last-mentioned bearing means and said central bearing.

20. A progressive cavity fluid drive apparatus comprising: a stator and a helicoidal rotor which has a combined rotary and orbital motion, a rotary drive shaft, a change speed transmission connecting said rotor to said drive shaft including a drive member and a driven member, one of said members including a housing, a seal between said housing and the other of said members, said seal having a part connected to said housing and a part connected to said other member, whereby said parts relatively rotate and orbit, and a lubricant in said housing.

21. A progressive cavity apparatus as defined in claim 20; said housing being connected with said rotor to rotate and orbit therewith.

22. A progressive cavity apparatus as defined in claim 20; said housing being connected with said shaft to rotate concentrically herewith.

23. A progressive cavity apparatus as defined in claim 20; said housing having a ring gear and the other member having a pinion in mesh with said ring gear.

24. A progressive cavity apparatus as defined in claim 23; including eccentric and concentric hearings mounting said pinion in said housing for relative rotary and orbital motion.

* * * * *